US006102134A

United States Patent [19]

Alsruhe

[11] Patent Number: 6,102,134

[45] Date of Patent: Aug. 15, 2000

[54] TWO-POSITION SCREWDRIVER

[75] Inventor: Wallis Alsruhe, Millers, Md.

[73] Assignee: Black & Decker Inc., Newark, Del.

[21] Appl. No.: 09/174,145

[22] Filed: Oct. 16, 1998

[51] Int. Cl.[7] ..... B25B 23/00; B25G 1/06

[52] U.S. Cl. ..... 173/217; 173/170; 173/216; 310/50

[58] Field of Search ..... 173/216, 217, 173/42, 213, 29, 45, 170; 310/50, 47

[56] References Cited

U.S. PATENT DOCUMENTS

| | | |
|---|---|---|
| 138,716 | 5/1873 | Tobey . |
| D. 301,496 | 6/1989 | Yonesawa et al. . |
| D. 304,419 | 11/1989 | Henck et al. . |
| D. 305,975 | 2/1990 | Emmerling . |
| D. 344,439 | 2/1994 | Izumisawa . |
| D. 380,658 | 7/1997 | Bruno et al. . |
| 901,700 | 10/1908 | Filson . |
| 984,778 | 2/1911 | Remisch . |
| 1,300,621 | 4/1919 | Key . |
| 1,301,802 | 4/1919 | Anderson . |
| 1,363,715 | 12/1920 | Brown . |
| 1,652,980 | 12/1927 | Glass . |
| 1,665,240 | 4/1928 | Weaver . |
| 1,835,943 | 12/1931 | Hoss . |
| 2,542,038 | 2/1951 | Lewis . |
| 2,572,444 | 10/1951 | Carden . |
| 2,617,619 | 11/1952 | Versen . |
| 2,630,730 | 3/1953 | Thornton . |
| 2,789,597 | 4/1957 | La Torre . |
| 2,890,613 | 6/1959 | Monckton . |
| 3,322,886 | 5/1967 | Warshawsky . |
| 3,509,629 | 5/1970 | Kidokoro . |
| 3,528,510 | 9/1970 | Peterson . |
| 3,552,786 | 1/1971 | Schmid . |
| 3,687,179 | 8/1972 | Totsu . |
| 3,905,429 | 9/1975 | Berger . |
| 3,973,605 | 8/1976 | DeCaro . |
| 3,986,272 | 10/1976 | Feierabent . |
| 4,158,970 | 6/1979 | Laughon . |
| 4,215,594 | 8/1980 | Workman, Jr. et al. . |
| 4,332,147 | 6/1982 | Grech . |
| 4,347,450 | 8/1982 | Colligan . |
| 4,522,270 | 6/1985 | Kishi . |
| 4,759,240 | 7/1988 | Lin . |
| 4,912,349 | 3/1990 | Chang . |
| 4,962,681 | 10/1990 | Yang . |
| 4,976,173 | 12/1990 | Yang . |
| 5,372,420 | 12/1994 | Van Deursen et al. . |
| 5,515,754 | 5/1996 | Elkins . |
| 5,533,581 | 7/1996 | Barth et al. ..... 173/217 |
| 5,737,982 | 4/1998 | Lin . |

FOREIGN PATENT DOCUMENTS

| | | |
|---|---|---|
| 0 280 527 A2 | 8/1998 | European Pat. Off. . |
| 33 23 088 C2 | 7/1984 | Germany . |
| 33 17 832 C2 | 3/1986 | Germany . |
| 36 02 992 A1 | 8/1987 | Germany . |
| 87 06 612 | 8/1987 | Germany . |
| 33 22 876 C3 | 10/1991 | Germany . |
| 41 16 343 A1 | 11/1992 | Germany . |
| 43 30 728 C2 | 6/1995 | Germany . |
| 43 40 740 A1 | 6/1995 | Germany . |
| 43 42 464 A1 | 6/1995 | Germany . |

*Primary Examiner*—Scott A. Smith
*Attorney, Agent, or Firm*—Harness, Dickey & Pierce, P.L.C.

[57] ABSTRACT

A two-position tool has a pair of housing members rotatable with respect to one another. A locking mechanism is coupled with one of the housing members to lock the two housing members in a plurality of positions with respect to one another. In a first position, the axes of the housing members are substantially colinear with one another and in a second position, the axes are angled with respect to one another. The locking mechanism includes an activation member and a pin coupled with the activation member. A detent member is coupled with one of the housing members. The detent member has a plurality of detents to receive the movable pin to lock the housing member in the plurality of positions.

19 Claims, 4 Drawing Sheets

TWO-POSITION SCREWDRIVER

BACKGROUND OF THE INVENTION

The present invention relates to hand held power tools and, more particularly, to hand held power tools which move to a plurality of positions.

Hand held power tools are utilized by general consumers as well as professional tradesmen. Hand held power tools have replaced the burdensome turning and rotation of manual hand tools. Specifically, in the screwdriver field, hand held power screwdrivers have become extremely popular. Hand held power screwdrivers ordinarily have the rotatable spindle co-axial with the screwdriver housing. When a drill motor is utilized with a screwdriver bit, the spindle is ordinarily at a 90° angle with respect to the drill motor handle.

When utilizing a stick type of power screwdriver, sometimes it is desirable to utilize the power screwdriver at various angles with respect to the workpiece. However, while the screwdriver is positioned at the varied angle, it does not always enable the user to have an adequate grip on the screwdriver to provide a desired force.

Accordingly, various types of positionable tools have served this function. Positionable tools ordinarily have a first position where the spindle is co-axial with the tool housing and a second position where the spindle is angled with respect to the tool housing. Thus, the user, when necessary, angles the spindle with respect to the remaining portion of the housing to enable a better grip on the power tool. The better positioning of the spindle enables the user to provide a desired force onto the fastener.

Several types of positionable tools exist in the art. While these tools appear to be satisfactory for their intended purpose, designers strive to improve the art.

SUMMARY OF THE INVENTION

The present invention provides the art with a positionable hand held power tool. The power tool is provided with a mechanism to actively retain the housing portions in a plurality of positions with respect to one another. The present invention provides an active bias member to lock the housing portions with respect to one another.

In accordance with a first aspect of the invention, a tool operated in a plurality of positions comprises two housing members each defining an axis. A pivot couples the two housing members for pivotal movement with respect to one another. A lock mechanism is coupled with one of the housing members for locking the two housing members in a plurality of positions with respect to one another. In a first position, the axes of the housing members are generally colinear. In a second position, the axes are angled with respect to one another. The lock mechanism includes an activation member. A movable pin is coupled with the activation member. A detent member is coupled with one of the housing members. The detent member includes a plurality of detents for receiving a movable pin to lock the housing members in one of the plurality of positions. A guide mechanism is also present which directs the movement of the movable pin. The guide mechanism enables movement of the pin in a plurality of directions. The guide mechanism includes a member extending from the activation member which includes a slot to receive the pin and enable movement of the pin in the slot. The guide mechanism also includes at least one channel on one of the housing members for guiding movement of the pin. A biasing member is coupled with the activation member to apply a force on the pin to maintain the pin in the detents. The activation member is moved to remove the pin from a detent to enable pivoting of the housing members with respect to one another. Also the detent member includes a cam surface to move the pin in a desired direction.

In accordance with a second aspect of the invention, a two-position tool is disclosed comprising two housing members with a pivot coupling the two members together with one another to enable pivoting of the two members with respect to one another. At least two detents are on one of the housing members. A pin is on the other of the housing members and is movable in two directions to be received in at least two detents to maintain the housing members in at least two positions with respect to one another. A biasing member applies a force on the pin to actively maintain the pin in the detents. A guide member is coupled with one of the housing members to guide the pin in a first direction. A second guide member is on the other housing to guide the pin in a second direction. An activation member is coupled with the pin to move the pin in and out of the detents.

In accordance with a third aspect of the invention, a two-position tool comprises a pair of housing members pivotal with respect to one another. One of the housing members has at least two detents. A pin is on the other housing member to be received by the detents. The pin is movable and biased such that as the pin moves out of one detent, the housing members may be pivotal with respect to one another and the biased pin is forced into the other detent to maintain a tool in a second position. A guide member is coupled with one of the housing members to guide the pin in a first direction. A second guide member is on the other housing member to guide the pin in a second direction. An activation member is coupled with the pin to move the pin in and out of the detents. The guide mechanism includes a member extending from the activation member which includes a slot to receive the pin. The pin is movable in the slot. The second guide members includes at least one channel in the housing member to guide movement of the pin. A biasing member is coupled with the activation member to apply a force on the pin to actively maintain the pin in the detents. The detent member also includes a cam surface to move the pin.

From the following detailed description, taken in conjunction with the accompanying drawings and subjoined claims, other objects, features and advantages of the present invention will become more fully apparent to one skilled in the art.

DETAILED DESCRIPTION OF THE PREFERRED EMBODIMENT

Figure 1:
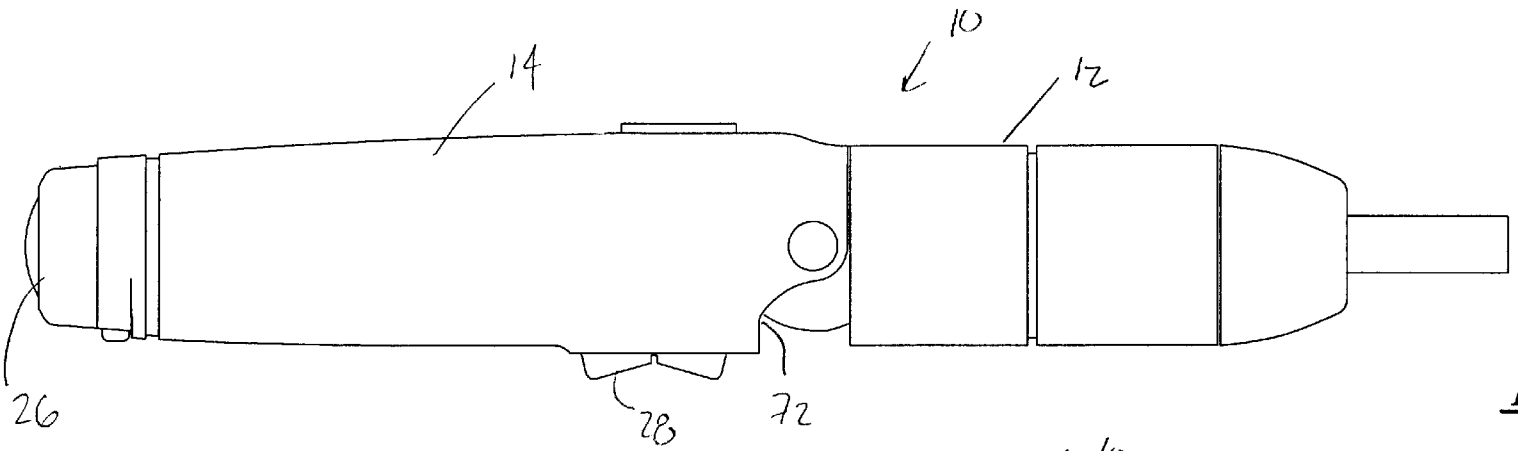
FIG. 1 is a plan view of a two-position hand tool in accordance with the present invention.
Figure 2:
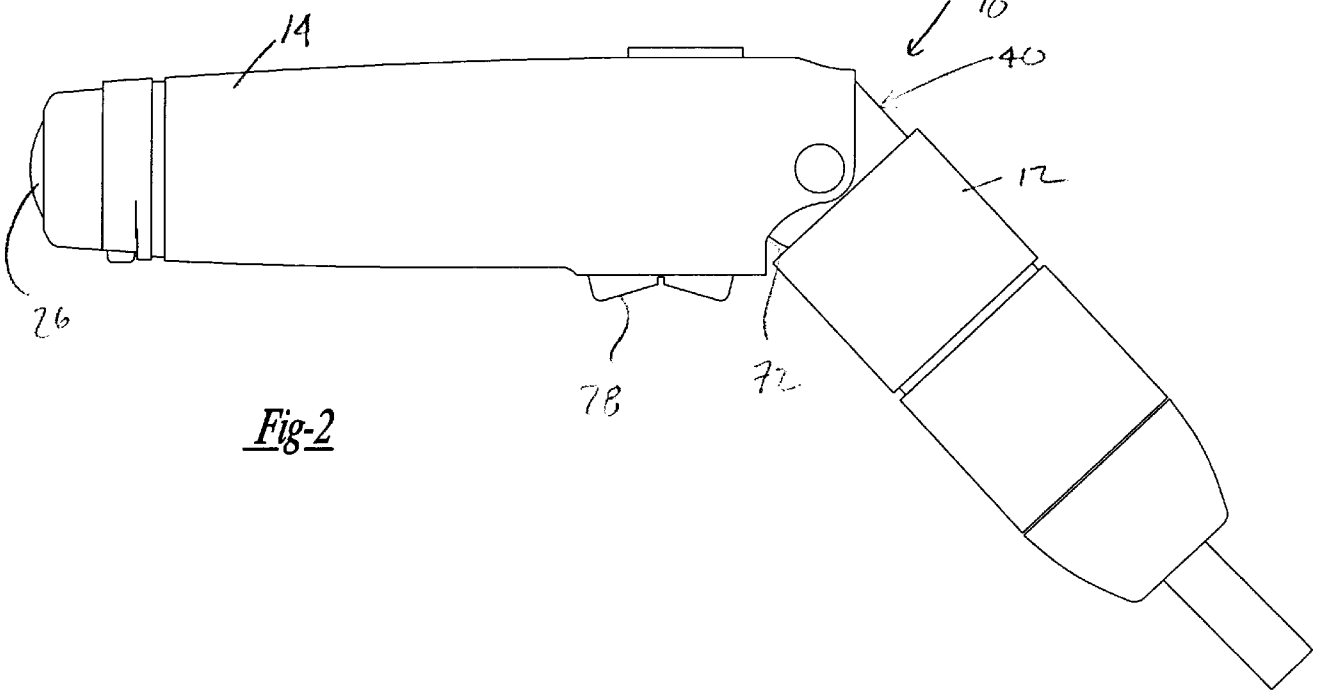
FIG. 2 is a plan view of the tool of FIG. 1 in a second position.

Turning to the figures, a hand held power tool is illustrated and designated with the reference numeral 10. The power tool 10 includes a first housing member 12 and a second housing member 14. The housing members 12 and 14 are pivotal with respect to one another. The housing portion 12 includes a motor 18 driving a transmission 20 which, in turn, drives the output spindle 22. The second housing member 14 includes a cavity 24 to receive a battery 26. A switch 28 is electrically coupled with the battery 26 and the motor 18 to drive the spindle in a forward and reverse direction.

The first housing member 12 includes a pair of clam shell halves 30 and 34 which are coupled with one another to form the housing member 12. The housing member 12 includes a rear portion 40 which opposes the spindle 22. The rear portion 40 includes an aperture 42 to receive a pivot 44 from the second housing member 14. Also, the rear portion includes a pair of detents 46 and 48 separated by a cam surface portion 50. The detents 46 and 48 are on the outer arcuate periphery of the rear portion 40. Also, the rear portion 40 includes a second aperture 52 to enable electrical wires, which extend to the motor, to pass into the second housing member 14.

The second housing member 14 includes a pair of clam shaped housing halves 60 and 62. The housing halves 60 and 62 define apertures 64, 66 and 68. Aperture 66 receives the motor forward and reverse switch 28. The aperture 64 receives an activating member 70. Aperture 68 receives the rear portion 40 of the first housing member 12. The housing portion 14 also includes a cut-out portion 72 which enables the first housing portion 12 to rotate into the cut-out portion 72.

The activation member 70 is slidable in a channel 74 in the housing halves 60 and 62. The activation member 70 has an extending member 78 which receives a biasing member 80. One end of the biasing member 80 rests against an abutting wall 82 in the housing member 14. The biasing member 80 provides an active force on the activation member 70. The activation member 70 also includes a pair of extending fingers 84 and 86. The fingers 84 and 86 include oblong slots 88. A pin 90 is received within the slots 88. The slots 88 enable the pin to move within the slots in a first direction as the activation member 70 is slid along channel 74. A pair of guide channels 94 and 96 are formed on the interior surfaces of the housing halves 60 and 62. The guide channels 94 and 96 each receive an end of the pin 90. The guide channels 94 and 96 enable the pin to slide within the channels 94 and 96 in a second direction as the activation member 70 is moved in the channel 74.

Figure 3:
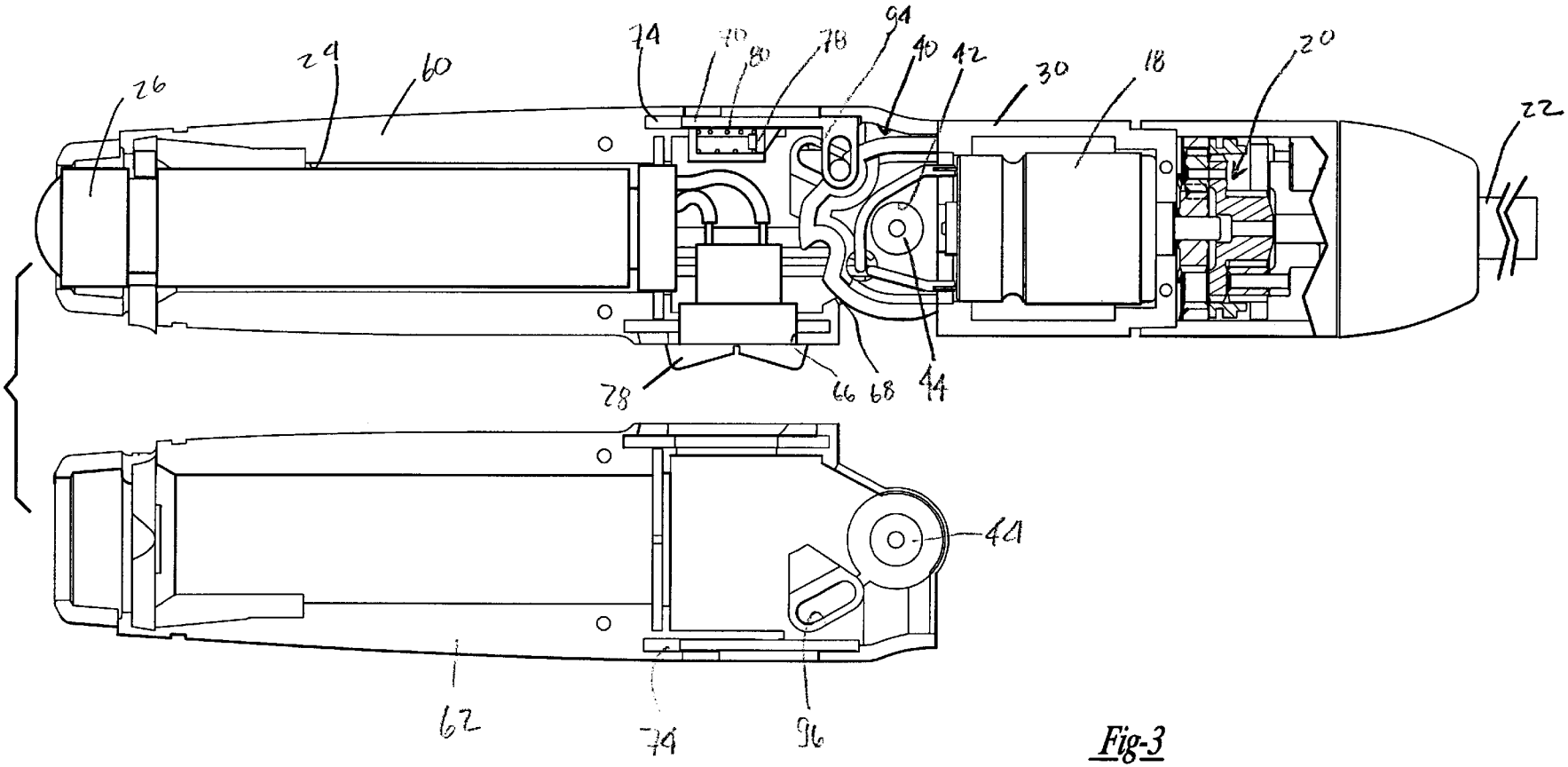
FIG. 3 is a cross-section view along line 3—3 of FIG. 1 with an inside plan view of the housing.
Figure 4:
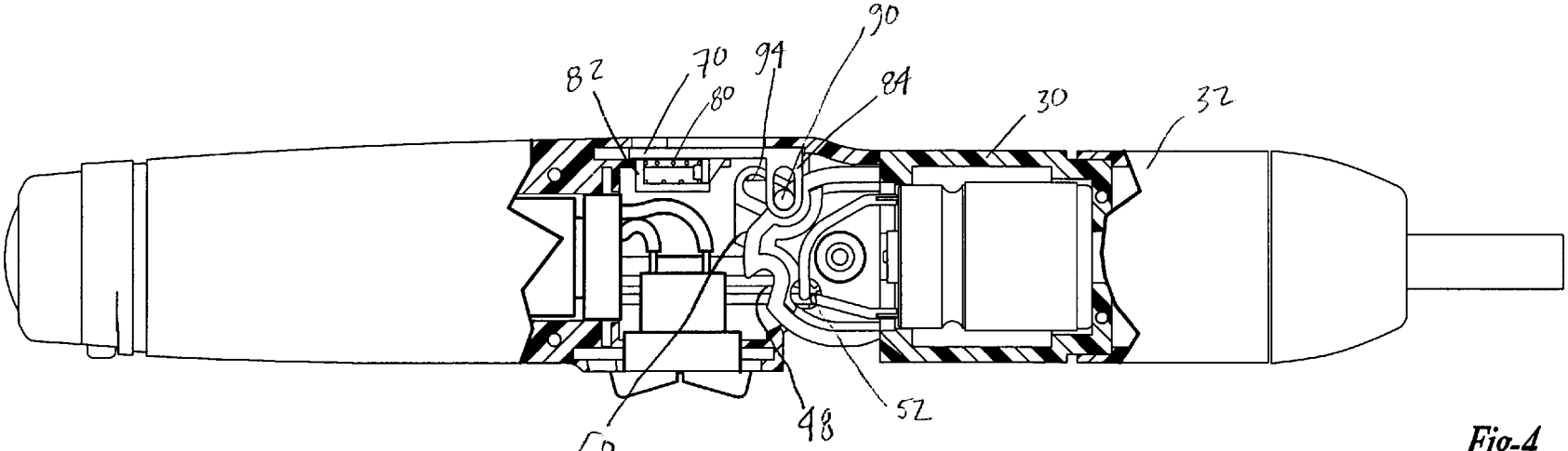
FIG. 4 is a partial cross-section view of the housing of FIG. 1.
Figure 5:
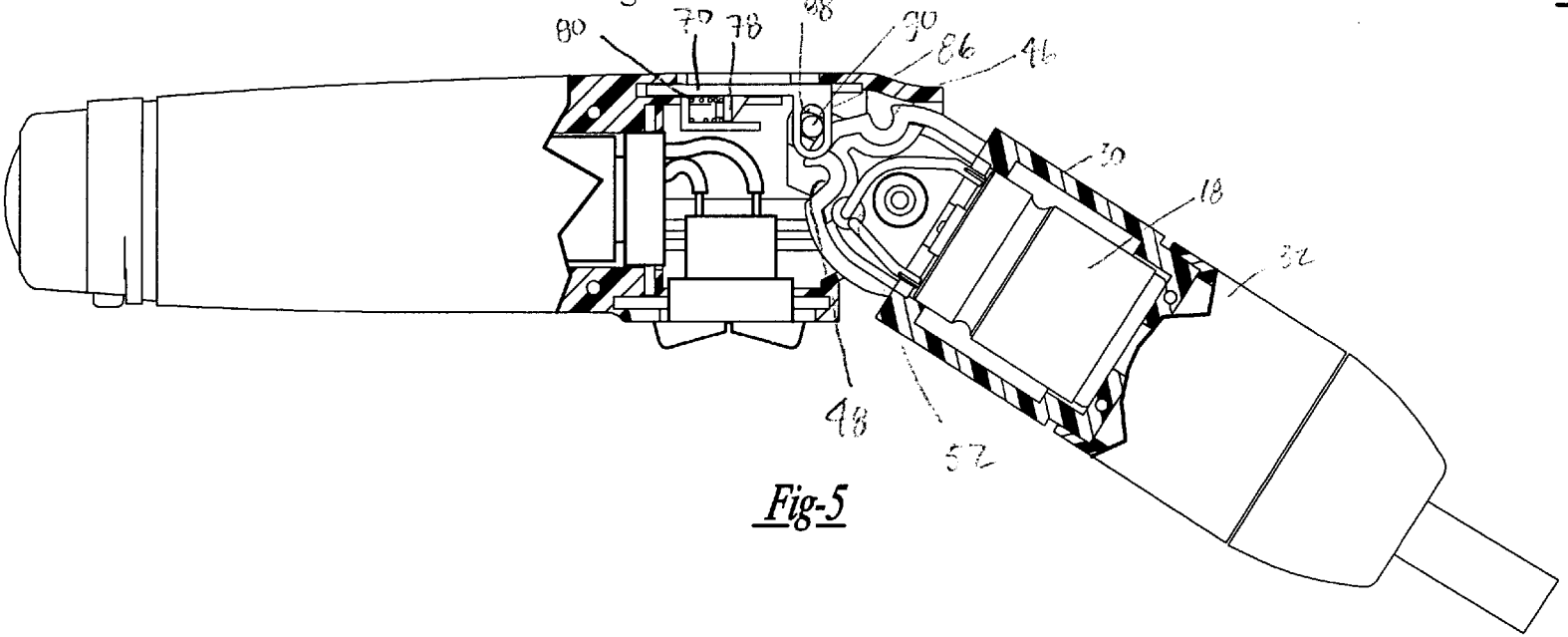
FIG. 5 is a partial cross-section view like FIG. 4 during rotation of the housing members with respect to one another.
Figure 6:
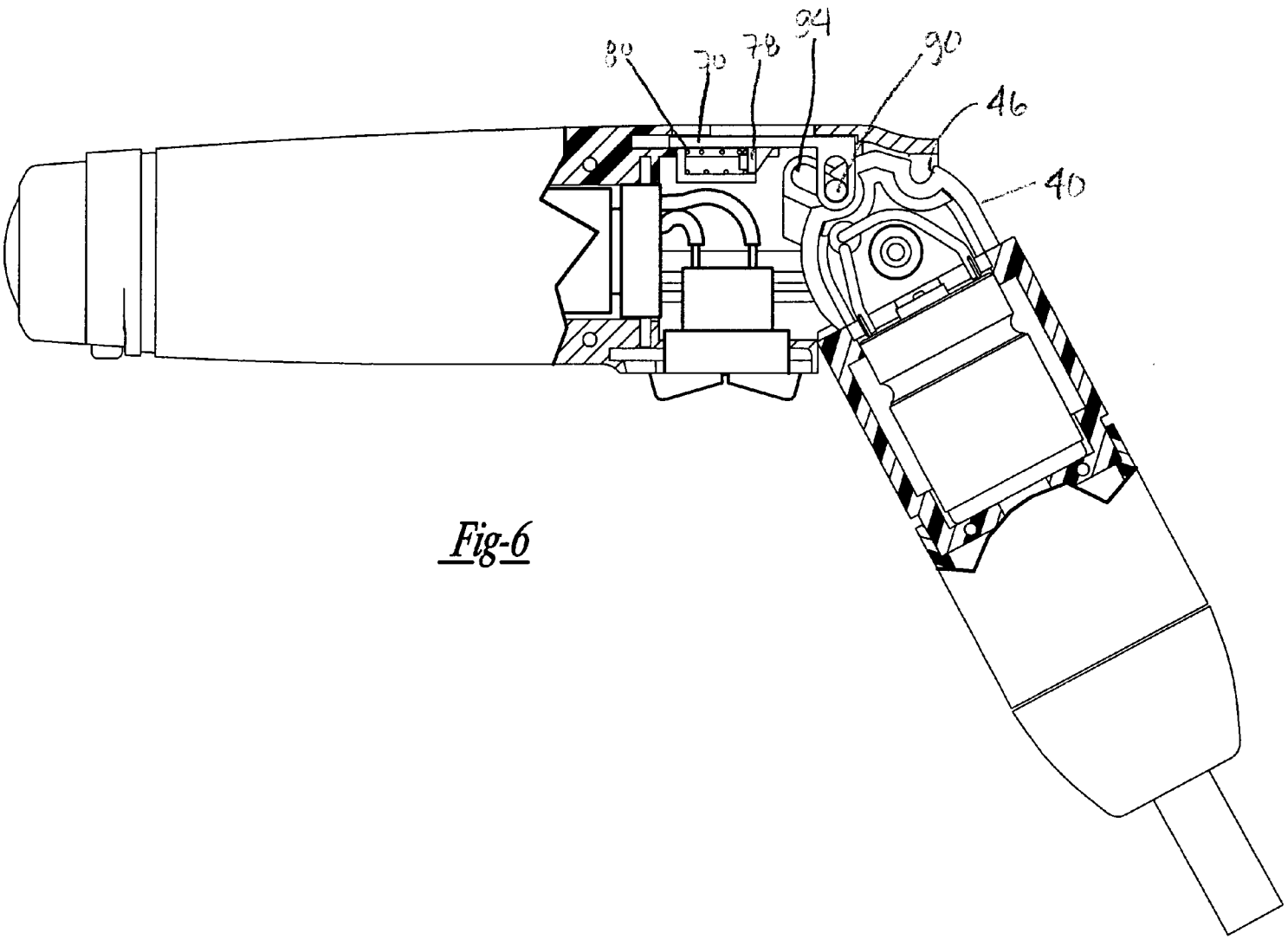
FIG. 6 is a view like FIG. 5 in a second position.

Turning to FIGS. 3–6, a better understanding of the activation member 70 will be described. As seen in FIG. 3, the pin 90 is actively biased in detent 46. The pin locks the housing members in a first position with respect to one another. The activation member 70 is then moved along channels 74 against the biasing force of spring 80. As this occurs, the pin 90 is moved along channels 94 and 96 of the housing halves 60 and 62. In order to move the housing members 12 and 14 with respect to one another, the housing members 12 and 14 are pivoted with respect to one another. When releasing the force on the actuation member 70, the biasing spring exerts a force which acts on the pin 90, forcing it against the surface 50. As the end of the cam surface 50 passes the pin 90, the biasing spring 80 actively forces the pin 90 into detent 48 to lock the motion. Thus, the housing members 12 and 14 are locked in a second position with respect to one another. While two detents are illustrated in the periphery of the housing member 12, more detents could be added to lock the housing members in additional positions with respect to one another.

While the above detailed description describes the preferred embodiment of the present invention, the invention is susceptible to modification, variation, and alteration without deviating from the scope and fair meaning of the subjoined claims.

What is claimed is:

1. A tool operable in at least two positions, comprising:

two housing members, each defining an axis;

a pivot coupled with said two housing members for pivotally coupling said two housing members with one another;

a lock mechanism coupled with one of said housing members for locking said two housing members in a plurality of positions with respect to one another such that in a first position said axes are substantially colinear and in a second position said axes are angled with respect to one another and said axes are in the same plane during pivoting of said housing members;

said lock mechanism including an activation member;

a movable pin coupled with said activation member;

a detent member coupled with one of said housing members, said detent member having a plurality of detents for receiving said movable pin for locking said housing members in said plurality of positions and a cam surface on said detent member for moving said pin.

2. The tool according to claim 1, wherein a guide mechanism directs the movement of said movable pin.

3. The tool according to claim 2, wherein said guide mechanism enables movement of said pin in a plurality of directions.

4. The tool according to claim 3, wherein said guide mechanism includes a member extending from said activation member having a slot for receiving said pin and enabling movement of said pin in said slot.

5. The tool according to claim 4, wherein said guide mechanism includes at least one channel on one of said housing members for guiding movement of said pin.

6. The tool according to claim 1, wherein a biasing member is coupled with said activation member for applying a force on said pin for actively maintaining said pin in said detents.

7. The tool according to claim 1, wherein said activation member being movable and upon movement of said activation member, said pin being withdrawn from said detent for enabling pivoting of said housing members with respect to one another.

8. A multi-position tool comprising:

two housing members;

a pivot coupling said two housing members with one another for enabling said two housing members to pivot with respect to one another;

at least two detents on one of said housing members;

a pin on the other of said housing members, said pin being movable in two directions during positioning of said tool, one direction being substantially vertical and one direction being substantially horizontal, for being received in said at least two detents for maintaining said housing members in at least two positions with respect to one another.

9. The multi-position tool according to claim 8, wherein a biasing member being coupled with one of said housing members for applying force on said pin for actively maintaining said pin in said detents.

10. The multi-position tool according to claim 9, wherein a guide member being coupled with one of said housing members for guiding said pin in a first direction.

11. The multi-position tool according to claim 10, wherein a second guide member being on the other housing member for guiding said pin in a second direction.

12. The multi-position tool according to claim 8, wherein an activation member is coupled with said pin for moving said pin in and out of said detents.

13. A multi-position tool comprising:

a pair of housing members pivotal in the same plane with respect to one another, one of said housing members having at least two detents and a cam surface;

a pin on the other housing member being received by said detents, said pin being movable on said cam surface and biased such that as said pin moves out of one detent, said housing members may be pivoted with respect to one another and said biased pin being forced into said other detents for maintaining a second position on said tool.

14. The multi-position tool according to claim 13, wherein a guide member being coupled with one of said housing members for guiding said pin in a first direction.

15. The multi-position tool according to claim 14, wherein a second guide member being on the other housing member for guiding said pin in a second direction.

16. The multi-position tool according to claim 15, wherein a guide mechanism including at least one channel on one of said housing members for guiding movement of said pin.

17. The multi-position tool according to claim 14, wherein said guide mechanism including a member extending from an activation member having a slot for receiving said pin and enabling movement of said pin in said slot.

18. The multi-position tool according to claim 13, wherein an activation member being coupled with said pin for moving said pin in and out of said detents.

19. The multi-position tool according to claim 13, wherein a biasing member being coupled with an activation member for applying a force on said pin for maintaining said pin in said detents.

* * * * *